United States Patent [19]

Rohr et al.

[11] Patent Number: 4,707,643

[45] Date of Patent: Nov. 17, 1987

[54] ROTARY SPEED RATIO CONTROL FOR A MULTIPLE ROTARY DRIVE SYSTEM FOR A TEXTILE-WORKING MACHINE

[75] Inventors: Gustav Rohr, Heidelberg; Karl-Heinz Vetter, St. Leon-Rot, both of Fed. Rep. of Germany

[73] Assignee: Frankl & Kirchner GmbH, Schwetzingen, Fed. Rep. of Germany

[21] Appl. No.: 862,059

[22] Filed: May 12, 1986

[30] Foreign Application Priority Data

May 10, 1985 [DE] Fed. Rep. of Germany ..... 3516825

[51] Int. Cl.[4] ..... H02P 5/46

[52] U.S. Cl. ..... 318/77; 318/302; 318/161; 318/85; 318/60; 74/665 GE; 112/315; 112/277

[58] Field of Search ..... 318/77, 60, 85, 161, 318/302, 4, 6, 269; 112/314, 315, 303, 274, 275, 277, 220, 221, 158 E, 449, 453, 464; 74/664, 665 F, 665 G, 665 GE; 192/9, 12 BA; 474/86, 113

[56] References Cited

U.S. PATENT DOCUMENTS

| | | | |
|---|---|---|---|
| 3,921,770 | 11/1975 | Oaab | 112/220 |
| 4,108,093 | 8/1978 | Watanabe | 112/453 |
| 4,161,921 | 7/1979 | Nishida | 112/275 |
| 4,233,919 | 11/1980 | Takahashi | 112/277 |
| 4,240,368 | 12/1980 | Adams | 474/86 |
| 4,261,273 | 4/1981 | Matthey | 112/220 |
| 4,289,087 | 9/1981 | Takenoya | 112/453 |
| 4,386,301 | 5/1983 | Neki | 112/277 |
| 4,503,792 | 3/1985 | Cook | 112/220 |
| 4,570,555 | 2/1986 | Reinke | 112/220 |

*Primary Examiner*—William M. Shoop, Jr.
*Assistant Examiner*—Patrick C. Keane
*Attorney, Agent, or Firm*—Felfe & Lynch

[57] ABSTRACT

In the drive for a textile working machine, for the synchronized yet independently operable drive of at least two shafts, brake-clutch units associated with each shaft are provided, which are driven by a common electric motor. To achieve a regulation and control having good dynamic properties and fast response, provision is made for the brake-clutch units to be controlled such that the rotatory speed of the driven shaft of the first brake-clutch unit is given as a required value, and the rotatory speed of the second brake-clutch unit is synchronized through the rotatory speed of the driven shaft of the first brake-clutch unit, systems being provided for establishing the rotatory speed ratio.

6 Claims, 10 Drawing Figures

ROTARY SPEED RATIO CONTROL FOR A MULTIPLE ROTARY DRIVE SYSTEM FOR A TEXTILE-WORKING MACHINE

BACKGROUND OF THE INVENTION

The invention relates to a rotary speed ratio control for a multiple rotary drive system for a textile-working machine, for example, and a sweing machine, for more-specific example.

In a number of different textile-working machines, such as knitting machines or sewing machines, for example, two or more shafts which, in some cases, are very close together, have to be driven in coordination with one another but must be controllable independently of one another. One way of doing this would be to use an electric motor, and a stepper or a pulse-driven DC motor, more particularly, for rotating each shaft with electric pulse devices for coordinating the motors and, hence, the rotation of the individual shafts. For example, a pulse-emitting device on a first shaft could emit pulses in dependence upon the rotary speed the shaft, which thus assumes the character of a master shaft, to provide the basis for control of the rest of the shafts, which thus assume the character of slave shafts, with relative speed differences between any of the shaft produced electronically by frequency dividers or pulse-width changers, for example. Such solutions involving several independent electric motors operated in coordination are, however, technically complex and also require a relatively large amount of space, especially if it is necessary to provide each motor with additional equipment, such as cooling systems and the like.

U.S. Pat. No. 4,549,491 discloses another multiple-shaft rotary drive for a stitch group sewing machine.

U.S. Pat. No. 4,556,132 discloses a rotary drive for a sewing machine. It has an electric motor continuously operating at constant speed and a clutch-brake unit to produce a driving connection between the driving shaft of the electric motor and a driven shaft of the sewing machine by selective excitation of clutch or brake coils of the clutch-brake unit. On account of the extremely advantageous characteristics of this or similar drive systems, which are also developed technically to a high degree, it might appear desirable to drive plural shafts with a corresponding number of independent drives of this kind, but this would involve considerable cost and, in many applications, would be infeasibly large for the limited amount of available space.

German Utility Model Publication No. 83 30 328 discloses a buttonhole sewing machine having an electric motor driving a clutch-brake unit. The driven shaft of the clutch-brake unit is connected to two electromagnetic clutches, one of which produces a driving connection to an upper, sewing-instrumentality shaft of the sewing machine and the other, a driving connection for moving a feed dog. By actuating the latter clutch, the feed dog can be brought quickly into position before and after the actual sewing, and by actuating the former clutch, the sewing is produced while the feed dog is driven in the conventional manner, the latter clutch not being engaged in this phase.

U.S. Pat. No. 4,274,522 discloses a machine having a low-speed auxiliary motor in addition to a high-speed main motor. By an electromagnetic clutch and auxiliary V-belt, the auxiliary motor can be used to drive the main shaft otherwise driven by the main motor whenever the machine is to be driven by the low-speed auxiliary motor instead of the high-speed main motor for certain operations.

SUMMARY OF THE INVENTION

Accordingly, an object of the invention is to provide a multiple rotary drive system with a control having good dynamic characteristics and fast response for good synchronization among the different rotary elements of the drive system, preferably with substantially symmetrical construction of the control for each rotary element for economy and ease.

To this and other ends, the invention provides a rotary speed ratio control for a multiple rotary drive system of, for example, a textile-working machine and, more specifically, a sewing machine. The drive system has an arrangement for controlling the rotary speed of each of the plural rotary elements, for example, shafts of the dirve system. In the preferred embodiment, these arrangements are clutch-brake units. Control is therefore provided by appropriate engagement of the clutch and brake of each unit. The rotary speed ratio control has a device for sensing the rotary speed of each rotary element (shaft) of the drive system. A regulating and control unit then controls the drive system, i.e. the clutch and brake of all but one of the clutch-brake units, so that the sensed rotary speed of all but one rotary element is at a ratio to that of the one, master rotary element selected for that rotary element.

With regard to the possibilities for control and regulation, the system provided in accordance therewith constitutes a fundamental departure from known solutions of the problem using individual motors for driving each shaft, which have to be individually controlled and regulated. The conception according to the invention permits the use of time-tested brake-clutch units with their well-known high-speed and braking characteristics. It is also possible to keep the cost of the circuitry low and to use partially identical units as the controlling and regulating systems.

The circuit provided according to claim 2 for the continuous adjustment of the speed ratio makes it possible to adjust the drive individually to special performance requirements on textile working machines.

Claim 3 provides a concrete embodiment of the general idea of claim 1. In it, the system for the continuous adjustment of the speed ratio is embodied preferably according to claim 4, while the second speed regulating system can be constructed especially according to claim 5.

The system provided according to claim 6 for the step wise adjustment of the speed ratio makes allowance for the circumstance that, for many purposes, especially in a sewing machine equipped for controlling the driving of the main shaft and of the feed dog, for example, a certain rotatory speed ratio is established between the shafts on the basis of experience. It has been found in the sewing industry, for example, that a properly operating configuration conforming to practice must be such that the difference between each two steps of rotatory speed corresponds to a geometrical series. At the same time it must be possible to set the maximum rotatory speed individually. The configuration according to claims 7 and 8 allows for this, the gradation of the resistances according to claim 7 permitting the desired step differences, while the potentiometer provided according to claim 8 permits the setting of the maximum rotatory speed.

BRIEF DESCRIPTION OF THE DRAWINGS

Other features, advantages and details of the invention will appear from the following description of a merely preferred embodiment which illustrates but does not limit the control invention, the description thereof being made in conjunction with drawings, wherein.

DESCRIPTION OF THE PREFERRED EMBODIMENTS

Figure 1:
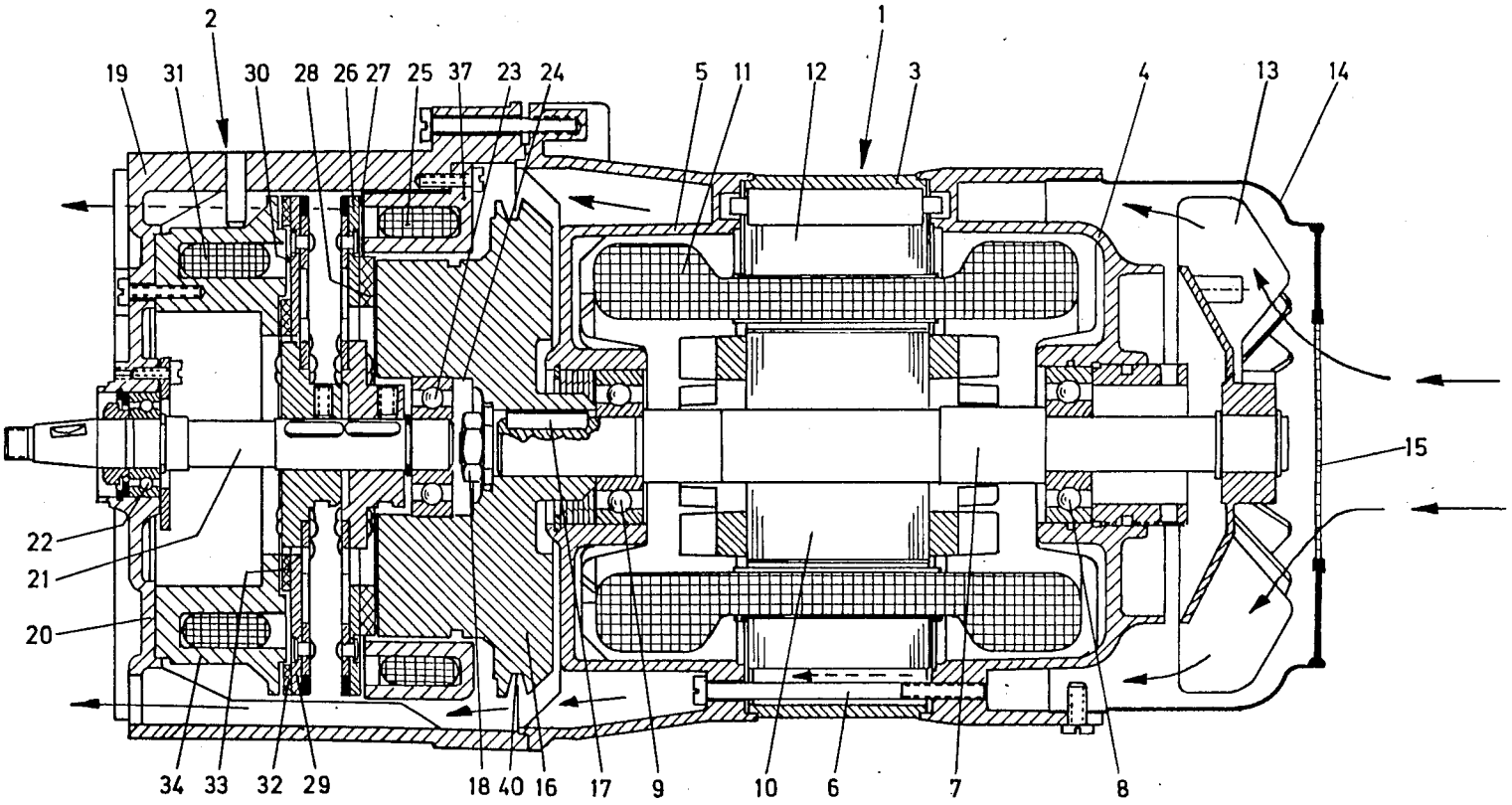
FIG. 1 is a cross-sectional, axial elevation of a motor and first clutch-brake unit of a multiple rotary drive system with which the preferred embodiment may be used.

FIG. 1 shows a continuous-running, asynchronous, short-circuit-rotor motor at 1 with a first clutch-brake unit at 2 of one preferred embodiment flange-mounted coaxially at one end thereof. The motor has a cylindrical stator case 3 with bearing shells 4 and 5 flange-mounted at the ends thereof by through-going tension bolts 6 (only one shown). A shaft 7 is rotatably mounted on ball bearings 8 and 9 in the bearing shells. A laminated rotor 10 is coaxially mounted on the shaft 7 for rotation therewith. A stator winding 11 and a laminated stator 12 are disposed concentrically thereabout on the stator case. A fan 13 is mounted on one end of the shaft 7 for rotation therewith to force cooling air through the motor. The fan is shrouded with a cover 14 mounted on the adjacent bearing shell 4. The cover has a screen 15 across an opening therein through which the cooling air is drawn. Such a motor is known.

The first clutch-brake unit at 2 is on the end of the motor at 1 opposite the fan 13. It has a flywheel 16 coaxially affixed to the shaft 7 of the motor, axially by a nut 18 and radially by a key-and-slot coupling 17. The flywheel 16 has a V-shaped groove 40 circumferentially thereabout for receiving a V-belt (41 in FIGS. 2 to 6).

A cylindrical, outer portion 19 of the clutch-brake unit at 2 about the flywheel 16 is flange-mounted at one end coaxially on the bearing shell 5 adjacent the flywheel 16 by screws. At its other end, remote from the motor at 1 and its bearing shell 5, the cylindrical, outer portion 19 is closed by a bearing shell 20 which is integral therewith. A driven shaft 21 of the clutch-brake unit at 2 is mounted coaxially with the shaft 7 of the motor at 1 on ball bearings 22 in the bearing shell 20 at one end and on ball bearings 23 in a bearing bore 14 in the flywheel 16 at the other end.

A winding 25 for an electromagnetic clutch is disposed concentrically around the flywheel 16 by an exo-core 37 surrounding the winding on three sides and fastened to the inside of the cylindrical, outer portion 19 of the clutch-brake unit at 2. A clutch disc 26 of the electromagnetic clutch is affixed to the driven shaft 21 of the clutch-brake unit for rotation therewith. The clutch disc is made of a magnetic material such as iron so that, when the coil 25 is energized, the clutch disc 26 is attracted across an air gap 27 between the core 37 and clutch disc 26 to bring friction facings 28 of the clutch disc 26 into engagement with an opposite face of the flywheel 16. The driven shaft 21 is then rotationally coupled to the motor shaft 7.

A winding 31 of an electromagnetic brake and its exo-core 34, surrounding it on three sides, is similarly disposed in the cylindrical, outer portion 19 of the clutch-brake unit at 2, spaced concentrically around its driven shaft 22, at the other end from the flywheel 16 and clutch disc 26, and fastened, non-rotatably, to the bearing shell 20. A brake disc 29 of the electromagnetic brake is mounted on the driven shaft 21 for rotation therewith. When the coil 31 is energized, the brake disc 29, also being of a magnetic material such as iron, is attracted across an air gap 30 between core 34 and brake disc 29 to engage a brake face of the core 34, thereby producing a braking action on the driven shaft 21.

The construction and manner of operation of such a clutch-brake unit are described in U.S. Pat. No. 3,543,901, which description is incorporated herein by reference.

A free end of the driven shaft 21 of the first clutch unit at 2 carries a belt pulley 38 (FIGS. 4 to 6) for rotation with the driven shaft. The belt pulley 38 serves, in the present embodiment, to drive an overlock sewing machine at 62 (FIG. 5).

Figure 2:
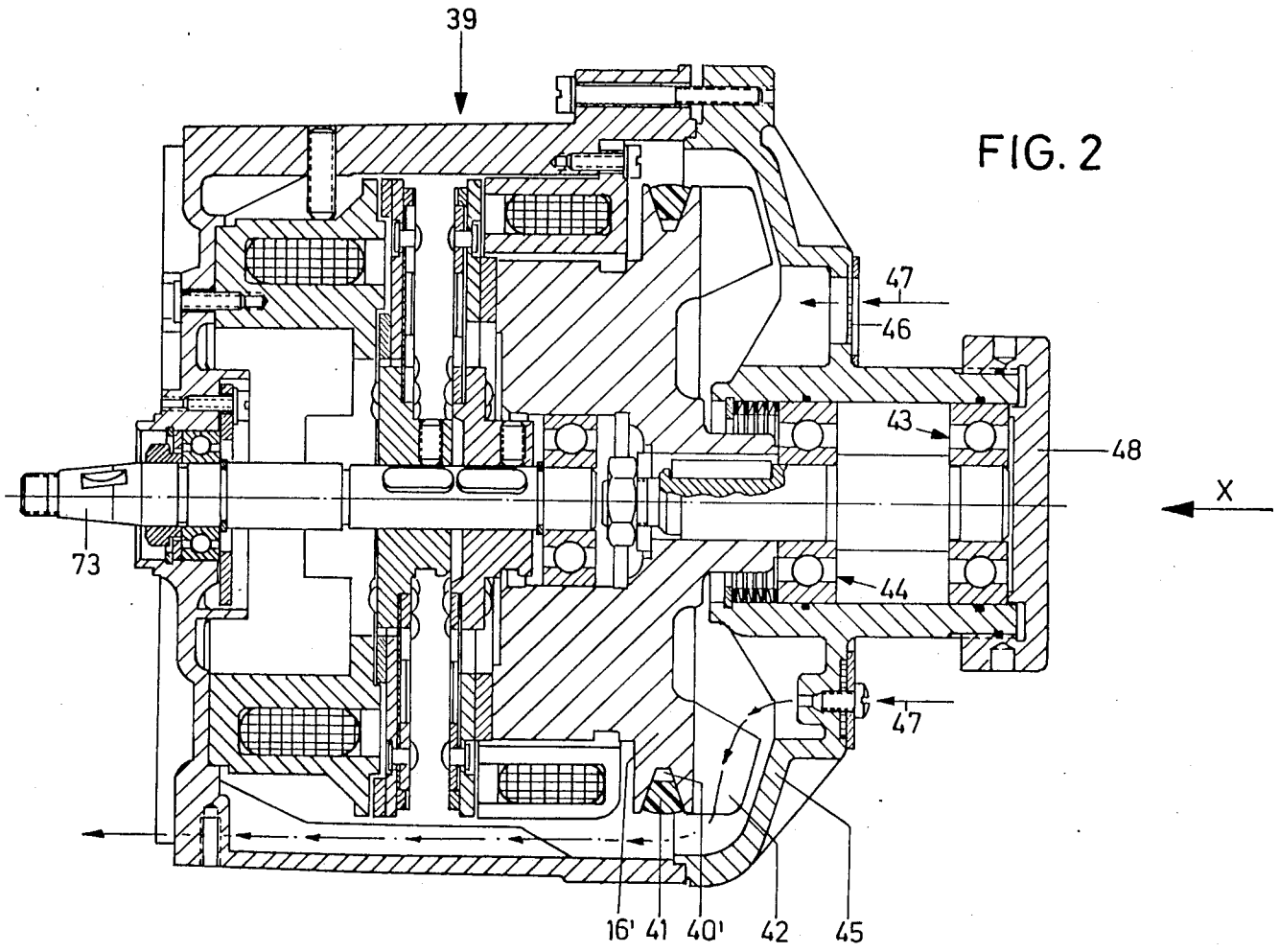
FIG. 2 is a cross-sectional, axial elevation along line 11—11 of FIG. 3, of a second clutch-brake unit of the multiple rotary drive system.
Figure 3:
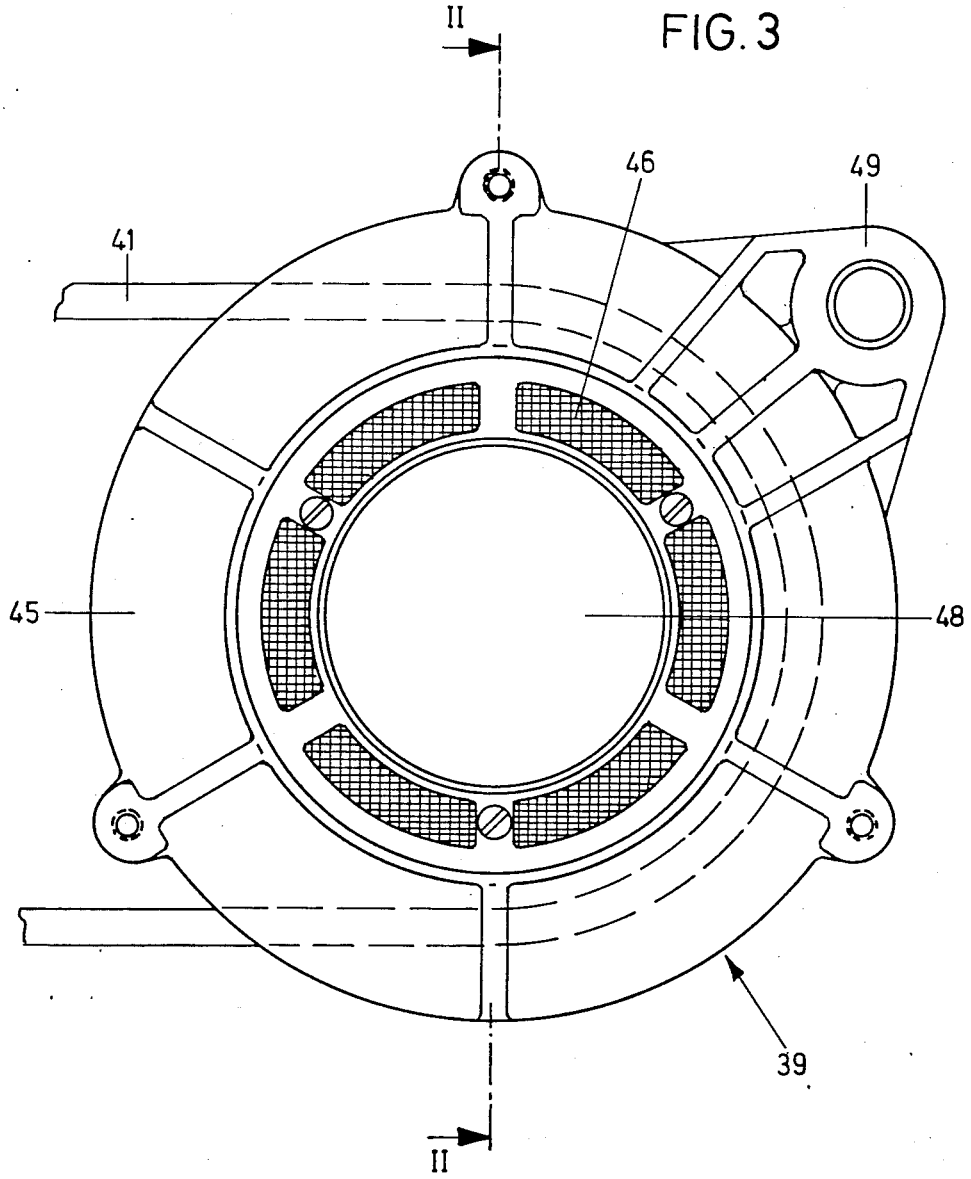
FIG. 3 is a front-end view of the second clutch-brake unit of FIG. 2.

A second clutch-brake unit at 39, as shown in detail in FIGS. 2 and 3, has a construction that is, substantially, identical to that the of the first clutch-brake unit at 2, as shown in detail in FIG. 1 and described above. Its flywheel 16' therefore also has a V-shaped belt-receiving groove 40' circumferentially thereabout. Other substantial identities need not be described again.

The second clutch-brake at 39 differs from the first at 2, however, in that the flywheel 16' has a fan 42 like the fan 13 (FIG. 1) of the electric motor at 1 (FIG. 1). For this, the flywheel 16' is bolted and keyed to a shaft mounted on ball bearings 43 and 44 of a final bearing shell 45 covering the front end of the second clutch-brake unit at 39. The final bearing shell 45 has a screen 46 corresponding to the fan screen 1b (FIG. 1) of the motor at 1 (FIG. 1). The arrows 47 indicate the direction of the ventilation. A threaded cap 48 on the final bearing shell 45 permits axial shifting of the flywheel 16' in a manner known in itself. A mounting car 49 (FIG. 3) of a bracket about the second clutch-brake unit at 39 serves for connecting it to a turning link 50 (FIG. 4) for mounting the second clutch-brake unit at 39 to a mounting plate 51 (FIG. 4).

Figure 4:
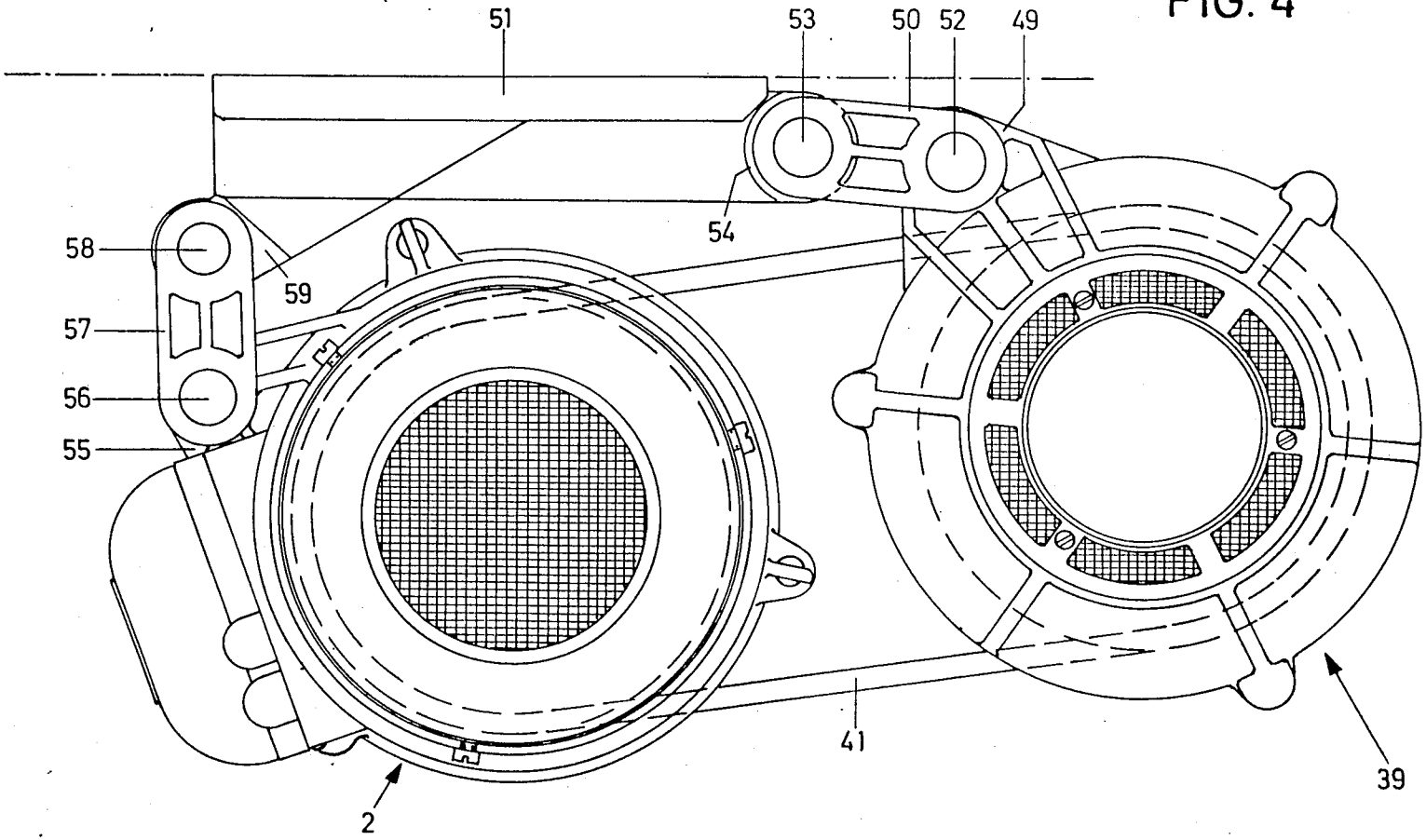
FIG. 4 is a front-end view of the motor and first clutch-brake unit of FIG. 1 in operative association with the second clutch-brake unit of FIG. 3 (in a different position) on a common mounting plate therefor.
Figure 5:
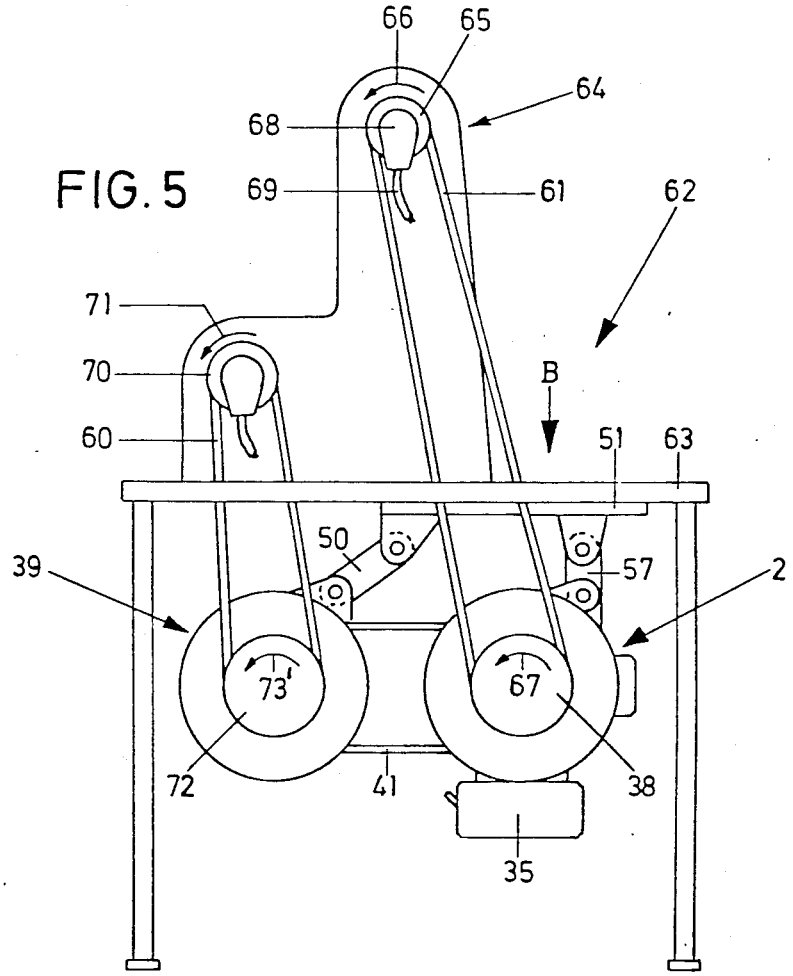
FIG. 5 is a rear-end view of the preferred embodiment with the motor, first and second clutch-brake units and mounting plate of FIG. 4 and a sewing machine having the preferred embodiment thereof and the mounting plate on a sewing table thereof.

FIG. 4 shows a way in which the first and second clutch-brake units at 2 and 39, respectively, can be fastened, in common, to the mounting plate 51. A lockable pivot (e.g., in the form of a screw with a nut) 52 joins the ear 49 of the second clutch-brake unit to a link 50 and a second lockable pivot 53 connects the link to an eye 54 of the mounting plate 51. In like manner, the first clutch-brake unit at 2 is provided with an ear 55 which is joined by a lockable pivot 58 to another ear 59 of the mounting plate 51. This arrangement makes it possible to adjust or readjust both the tension of a V-belt 41 which extends about the flywheels 16 (FIG. 1) and 16' (FIG. 2) received in their respective grooves 40 (FIG. 1), 40' (FIG. 2); as well as V-belts 60 and 61 (FIG. 5).

FIG. 5 shows the installation of the above described drive system in a so-called overlock sewing machine at 62. The overlock sewing machine, which is represented only diagrammatically, has a sewing table 63. The mounting plate 51 is fastened underneath the table. A head at 64 of the sewing machine at 62 is disposed on the other, top side of the sewing table.

The drive to the main shaft (not shown), but as known from U.S. Pat. No. 4,549,491, for example, and incorporated herein therefrom by reference, of the sewing machine at 62 is delivered through a belt pulley 65 in the direction of the arrow 66. The belt pulley 65 is driven through a V-belt 61 thereabout, and also about a belt pulley 38 fastened to the driven shaft 21 of the first clutch-brake unit at 2. The belt pulley 38 turns in the direction of the arrow 67, i.e., in the same sense as the belt pulley 65. A position sensing pickup 68 is also disposed on the main shaft. Its electrical cable 69 is connected to a control box 35 that is fastened to the first clutch-brake unit at 2.

Another belt pulley 70 serves to drive the so-called overlock feed dog. The belt pulley 70 is driven in the direction of the arrow 71 through a V-belt 60 thereabout, the V-belt 60 also extending about a belt pulley 72 on the driven shaft 73 of the second clutch-brake unit at 39. The belt pulley 72 turns in the direction of the arrow 73', that is, in the same direction as the belt pulley 38 of the first clutch brake unit at 2 and the belt pulley 70 of the everlock feed dog.

Figure 6:
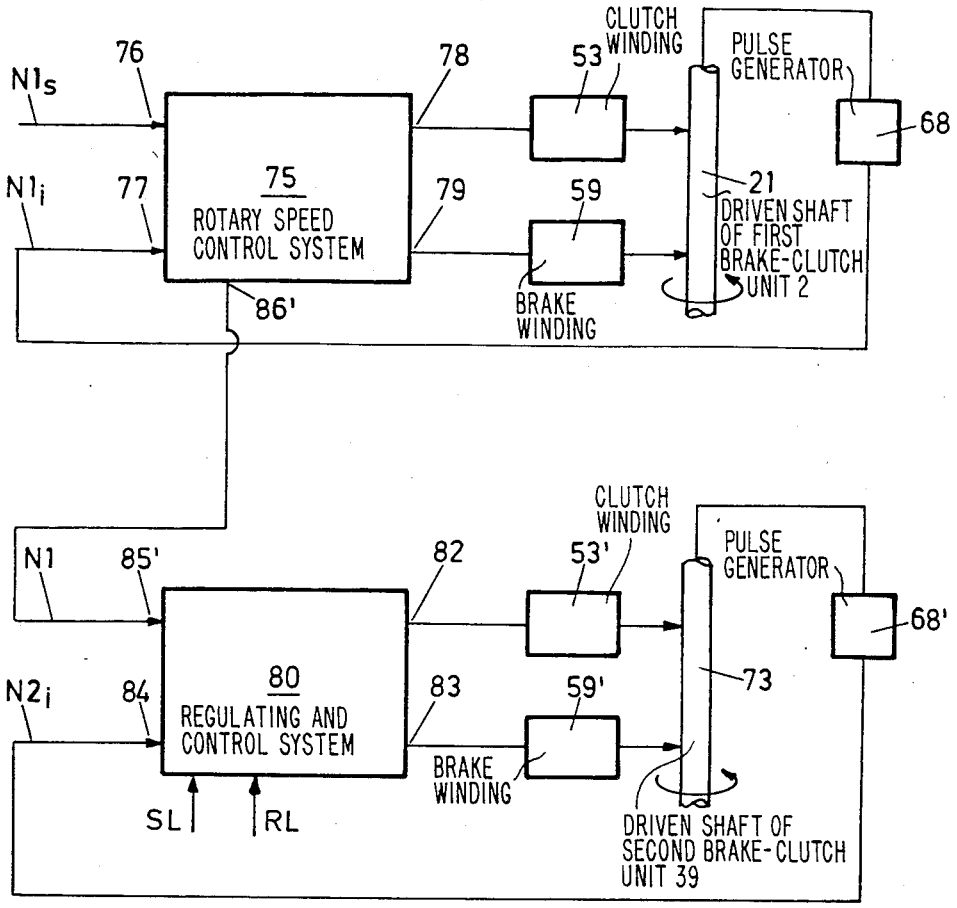
FIG. 6 is a block diagram of the preferred embodiment together with associated elements of the first and second clutch-brake units.

FIG. 6 shows a block diagram of the regulating and control system housed in the control box 35. This system includes a conventional first speed control system.

The speed control system 75 is given the required speed signal N1s at its input 76. To the other input 77 is fed the actual speed N1i which is derived from the pulse generator 68 which is disposed on the main shaft of the overlock sewing machine, which is drivingly connected to the driven shaft 21 of the first brake-clutch unit 2. The clutch winding 53 or brake winding 59 is actuated according to the signals given at the outputs 78, 79, so that the rotatory speed of the driven shaft 21 is controlled.

The driven shaft 73 of the second brake-clutch unit 39 is associated with a regulating and control system 80 which includes the rotatory speed control system 81 whose outputs 82 and 83 are connected to the clutch winding 53' and to the brake winding 59' of the second brake-clutch unit 39. By means of a pulse generator 68' disposed on the driven shaft 73 or on the shaft of the feed dog that is driven thereby, the actual speed N2i is fed to the regulating and control system through the input 84. The input 85' of the regulating and control system 80 is connected to the output 86' of the rotatory speed control system 75, and in this manner a signal corresponding to the rotatory speed N1 of shaft 21 is fed to the regulating and control system 80.

This signal serves for the synchronization of the rotatory speed of shaft 73, but this speed is individually adjustable, i.e., the rotatory speed ratio N1:N2 is adjustable.

Figure 7:
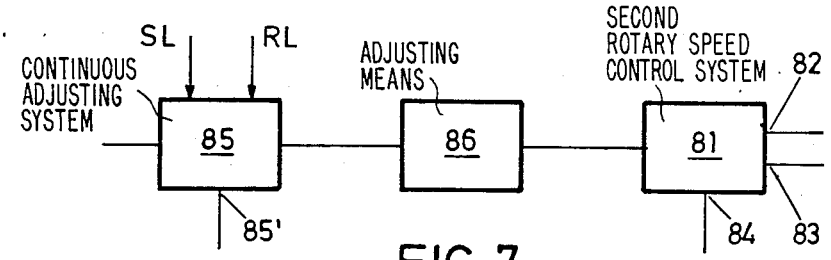
FIG. 7 is a more-detailed block diagram of a portion of the preferred embodiment shown in FIG. 6.

As represented in FIG. 7, for this purpose the regulating and control system 80 includes a continuous adjusting system 85 for adjusting the speed ratio, an adjusting means 86 for the step-wise input of the speed ratio and for the setting of the maximum rotatory speed, and the previously mentioned second rotatory speed control system 81.

Figure 8:
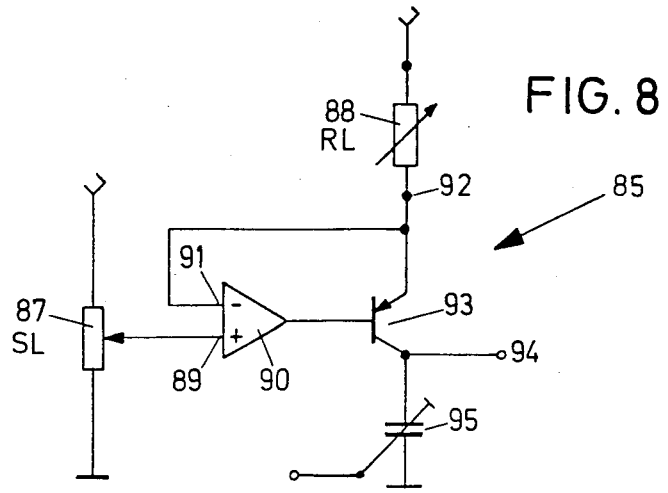
FIG. 8 is a schematic of a portion of the preferred embodiment shown in FIG. 7.
Figure 9:
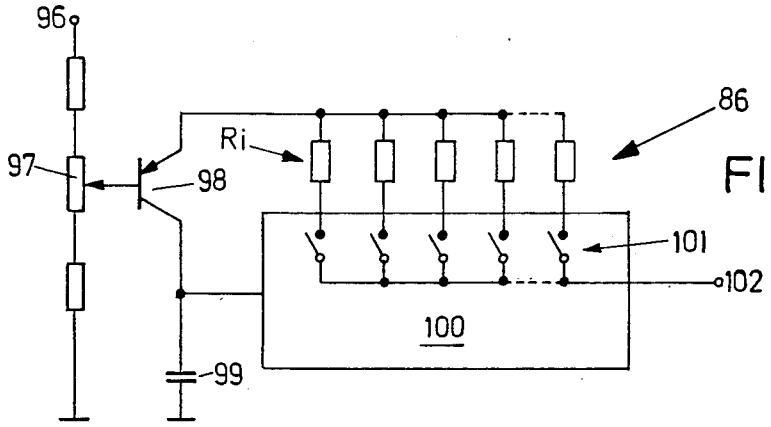
FIG. 9 is a schematic of a portion of the preferred embodiment shown in FIG. 7.
Figure 10:
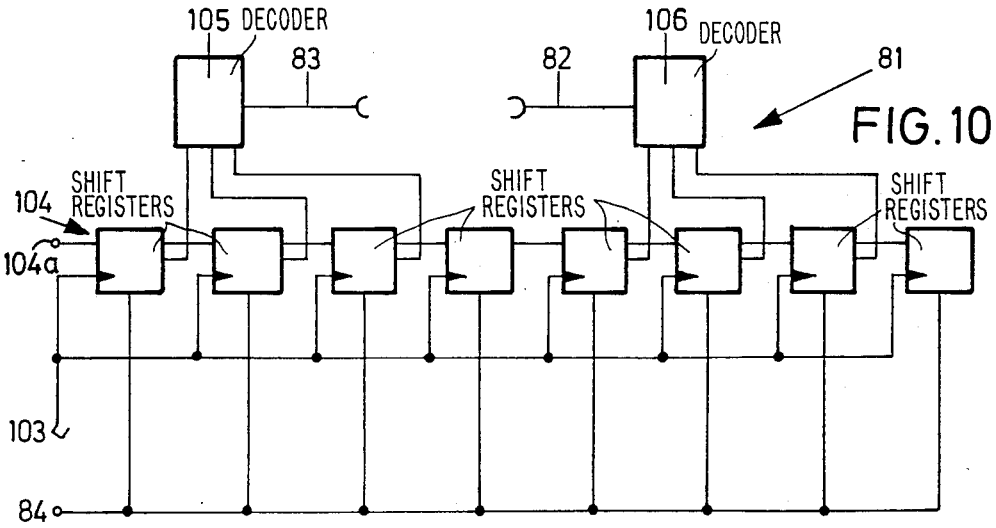
FIG. 10 is a schematic of a portion of the preferred embodiment shown in FIG. 7.

The essential part of the step-less adjustment of the rotatory speed ratio N1:N2 is represented diagrammatically in FIG. 8. Potentiometers serve as input means 87 and 88 for the stitch length SL and the overlock length RL. The center tap of the SL potentiometer is connected to the input 89 of an amplifier 90. The other input 91 of the amplifier 90 is connected to the terminal 92 of the RL potentiometer and simultaneously to the emitter of the transistor 93. The base of the transistor 93 is connected to the output 94 of the amplifier 90. The collector of the transistor 93 is connected on the one hand to the output 94 and on the other hand to the variable condenser 95, to which the input 85 of the control and regulating system 80 is applied. Depending on the setting of the RL and SL resistances, a modification corresponding to the quotient of SL over RL, i.e., the adjustment values of the corresponding potentiometers is performed.

The output signal thus formed at the output 94 is fed to the input 96 of the system 86. System 86 includes in a voltage dividing circuit a potentiometer 97 for setting the maximum rotatory speed of the driven shaft 74. The center tap of the potentiometer 97 is connected to the base of a transistor 98. The collector of transistor 98 is grounded through a condenser 99 and otherwise is connected to a circuit 100, not shown in detail because it is not essential to the invention. The emitter of the transistor 98 is connected in each case to the one side of a plurality of resistances $R_1$ connected in parallel, whose other end is applied to a switching system 101 which is part of circuit 100. The switching system 101 is connected to the output 102 of the adjusting system 86. By the selective actuation of the switching system, the stepped input of a speed ratio N1:N2 is possible such that a gradation corresponding to a geometric series can be established between the individual rotatory speeds.

The output 102 is connected to the input 103 of the second control system 81, whereby the required speed N2s of the driven shaft 73 is established. To the other input 84 the output of the pulse generator 68' is applied, which sets the actual speed N2i of the driven shaft 73.

An important component of the rotatory speed control system 81 is a shift register 104 which in the present embodiment is an eight-step shift register, the required-value frequency being greater by a factor of 4 than the actual-value frequency when the difference is zero. Accordingly, an actuation of the brake winding 59' is performed through a first decoder 105 and the output 83 when the required-value frequency is exceeded accordingly, in which case the decoder 105 is connected to the first three steps of the shift register 104, and in like manner the clutch windings 53' are actuated through a decoder 106 and the output 82 when the actual-value frequency falls below the required-value frequency, in which case the decoder 106 is connected to the last three steps of the shift register 104.

Furthermore, as not shown in detail in the drawing, sensors can be provided for the detection of the angular position of the main shaft of the sewing machine and the driven shaft of the feed dog, and means can be provided for the establishment of a specific angular position relationship.

It will be understood that the specification and examples are illustrative but not limitative of the present invention and that other embodiments within the spirit and scope of the invention will suggest themselves to those skilled in the art.

We claim:

1. Circuit for a drive for a textile working machine with a first drive and a second drive, which can be actuated in correlation with a first drive motor at a rotatory speed that is variable relative to the drive motor, especially in relation to a stitch length, comprising: a first drive including a continuously drivable electric motor having a driven shaft and a first brake-clutch unit connected with this driven shaft, which has a clutch disk and brake disk and including a nonrotating brake abutment and a flywheel bearing a clutchface, said brake disk being capable of being brought into frictional engagement with said nonrotating braking abutment and said clutch disk being capable of being brought into frictional engagement with said flywheel bearing said clutch face, a second such brake-clutch unit which can be operated in correlation with said electric motor but can be operated independently , said second brake-clutch unit including a flywheel drive mechanically derived from said electric motor, the first brake-clutch unit having a driven shaft and the second brake-clutch unit having a driven shaft, the brake-clutch units being actuated such that the rotatory speed of the driven shaft of the second brake-clutch unit is synchronized through the rotatory speed of the driven shaft of the first brake-clutch unit pulse generators associated, one with said driven shaft of said first brake-clutch unit and the other with said driven shaft of said second brake-clutch unit, said pulse generators putting out series of pulses whose frequency is proportional to the rotatory speed N1, N2 of said driven shaft of said first and second brake-clutch units, respectively, a first speed control system responsive to pulses of a first of said pulse generators for performing a comparison of a required speed value and actual speed value, a system including an adjusting system (SL and RL) and responsive to the rotatory speed value of the driven shaft of the first brake-clutch unit for a step-less setting of said rotatory speed ratio and forming from it, according to the setting of the adjusting system, a required rotatory speed value for said driven shaft of said second brake-clutch unit such-that $$N2 = N1 \times (SL/RL \times constant$$

and a second rotatory speed control system responsive to the required rotatory speed value of the driven shaft of the second brake-clutch unit and responsive to pulses of a second of said pulse generators proportional to the actual rotatory speed of the driven shaft of the second brake-clutch unit, the second brake-clutch unit having brake and clutch windings operated directly on the basis of the comparison of actual rotatory speed value and the required rotatory speed value of said driven shaft of said brake-clutch unit, said system for the step-less setting of said rotatory speed ratio including an amplifier having two inputs and an output, a transistor having a base, emitter and collector, a variable condenser, said system for the stepless setting of the rotatory speed ratio also including a first potentiometer as setting means (SL), having a center tap connected to a first input of said amplifier, a second potentiometer as a second setting means (RL), having one fixed contact connected to the other input of said amplifier and to the emitter of said transistor, the output of said amplifier being connected to the base of said transistor whose collector is connected to said variable condenser and to the input of the second rotatory speed control system, the output of the first rotatory speed control system being carried to said condenser.

2. Circuit according to claim 1, wherein the system for the establishment of the rotatory speed ratio (N1:N2) include a means for the step-less setting of the rotatory speed ratio (N1:N2).

3. Circuit according to claim 1, in which said second rotatory speed control system includes a shift register and decoders and in which the required-value pulse frequency for the second rotatory speed control system amounts to n times the actual-value pulse frequency when the control difference is zero, and in which the rotatory speed comparison is performed through said shift register of 2n steps, in which case, according to the ratio of the required-value and actual-value frequency, the outputs of the steps in question are set, so that through said decoders associated with the less than n steps or greater than n steps, respectively, the brake and clutch windings of the second brake-clutch unit are actuated.

4. Circuit according to claim 1, in which the systems for the selective establishment of the rotatory speed ratio (N1:N2) include a means for the step-wise establishment of the rotatory speed ratio.

5. Circuit according to claim 4, in which the means for the step-wise establishment of the rotatory speed ratio (N1:N2) include a switching system to which is subordinated a plurality of resistances connected in parallel whose values are graded with respect to one another such that the formula $R_n = R_0/q^n$ is fulfilled.

6. Circuit according to claim 5, characterized in that a potentiometer precedes the resistances.

* * * * *